United States Patent [19]

Idota et al.

[11] 4,242,442

[45] Dec. 30, 1980

[54] METHOD FOR PROCESSING SILVER HALIDE COLOR PHOTOGRAPHIC MATERIAL

[75] Inventors: Yoshio Idota; Minoru Yamada, both of Minami-ashigara, Japan

[73] Assignee: Fuji Photo Film Co., Ltd., Minami-ashigara, Japan

[21] Appl. No.: 86,623

[22] Filed: Oct. 19, 1979

[30] Foreign Application Priority Data

Oct. 19, 1978 [JP] Japan ..... 53-128883

[51] Int. Cl.[3] ..... G03C 5/32

[52] U.S. Cl. ..... 430/393; 430/430; 430/460; 430/461

[58] Field of Search ..... 430/393, 430, 461, 460, 430/398, 400

[56] References Cited

U.S. PATENT DOCUMENTS

| | | | |
|---|---|---|---|
| 3,770,437 | 11/1973 | Brugger et al. | 430/393 |
| 3,893,858 | 7/1975 | Wabnitz | 430/393 |
| 4,124,391 | 11/1978 | Ogawa et al. | 430/357 |

*Primary Examiner*—Mary F. Downey

*Attorney, Agent, or Firm*—Sughrue, Rothwell, Mion, Zinn and Macpeak

[57] ABSTRACT

A method which comprises processing an imagewise exposed and color developed silver halide color photographic material with a solution containing a ferric ion complex, a bromate and a water-soluble chloride is disclosed.

25 Claims, No Drawings

METHOD FOR PROCESSING SILVER HALIDE COLOR PHOTOGRAPHIC MATERIAL

BACKGROUND OF THE INVENTION

1. Field of the Invention

This invention relates to a method for photographic processing a silver halide color photographic material, and, specifically, to a method for photographic processing a silver halide color photographic material which has sufficient bleach activity and can always afford a color image of good quality.

2. Description of the Prior Art

In the processing of a silver halide color photographic material, it is the usual practice to expose the photographic material imagewise, develop the exposed photographic material (the photographic silver halide emulsion may be fogged in advance) with a developer containing an aromatic primary amine developing agent in the presence of a color-forming coupler to obtain a color image, simultaneously re-halogenate the developed silver formed, and to remove it together with the undeveloped silver halide by fixation (or bleach-fixation).

Heretofore, potassium ferricyanide, ferric chloride and a ferric complex of aminopolycarboxylic acid have been the main bleaching agents used. The potassium ferricyanide and ferric chloride are good bleaching agents in that they have sufficiently high rates of bleaching (rates of oxidation) and can oxidize the developed silver sufficiently within a given period of time. However, because a bleaching bath containing potassium ferricyanide as a bleaching agent liberates a cyanide ion upon photolysis and causes environmental pollution, measures must be taken to render the spent bleach bath completely hazard free.

A bleaching bath containing ferric chloride as a bleaching agent has a very low pH and very high oxidizing power and tends to corrode the components of a processor in which the bleach bath is filled. Moreover, in a washing step after bleaching, iron hydroxide precipitates in the emulsion layer causing so-called stain. For this reason, the photographic material which has been subjected to the bleaching treatment must be washed with an organic chelating agent, which does not serve to speed processing or save energy. Furthermore, from the environmental viewpoint, there is the risk of the generation of hydrogen halide gas.

Metal complexes of organic acids such as a metal complex of an aminopolycarboxylic acid cause less environmental pollution than does potassium ferricyanide or ferric chloride, and these metal complexes have gained increasing acceptance as bleaching agents in recent years. Unfortunately, organic metal complexes generally have relatively low oxidizing power and insufficient bleaching power. A bleaching bath containing such a metal complex as a bleaching agent may produce the desired result when used to treat a silver halide color photographic material of low sensitivity composed mainly of a silver chlorobromide emulsion. However, it exhibits insufficient bleaching action on a silver halide color photographic material of high sensitivity composed mainly of a spectrally sensitized silver chlorobromoiodide or silver iodobromide emulsion, especially on a silver halide color photographic material containing an emulsion having a high silver content. As a result, removal of silver is poor, or the dye formed by oxidative coupling between the oxidation product of the color developing agent and the coupler remains as a leuco dye, which is the reaction intermediate, even after the bleaching step, and a dye cannot be completely formed (so-called poor color reproduction). The term "emulsion having a high silver content", as referred to herein, denotes an emulsion containing a total amount of silver in blue-sensitive, green-sensitive and red-sensitive silver halide emulsion layers of at least about 30 mg per 100 $cm^2$.

Unless this problem is solved, it is impossible to achieve rapid processing of a high sensitivity silver halide color photographic material.

As one solution to the problem, U.S. Pat. No. 3,770,437 suggests the addition of a bromate to an iron complex of aminopolycarboxylic acid. It has been found, however, that immediately after formulation such a bleaching bath is suitable—the leuco dye product is converted to a dye. However, when the bleaching bath is allowed to stand after formulation, its oxidizing ability is rapidly reduced and the oxidation of the leuco product becomes insufficient. This is a fatal defect, which also occurs at the acidity (i.e., pH of 4 to 6) at which the bleaching bath is said to be relatively stable. Another defect is that magenta stain occurs.

In an attempt to remove this defect, Japanese Patent Application (OPI) No. 29719/78 (The term "OPI" as used herein refers to a "published unexamined Japanese patent application") suggests the provision of a solution containing a bromate before the bleaching bath. However, since this increases the processing one step it is complicated and the processing time is prolonged.

SUMMARY OF THE INVENTION

A first object of this invention is to provide a method for processing a silver halide color photographic material without environmental pollution at a high bleaching speed.

A second object of this invention is to provide a method for processing a silver halide color photographic material without stain.

A third object of this invention is to provide a method for processing a silver halide color photographic material which is free from poor color reproduction, whereby a dye formed by oxidative coupling remains as a leuco dye even after bleaching.

A fourth object of this invention is to provide a method for processing a silver halide color photographic material while maintaining stable bleaching ability.

A fifth object of this invention is to provide a method for processing a silver halide color photographic material which increases the rate of bleaching, shortens the processing time and gives a color image having good quality.

A sixth object of this invention is to provide a method for processing a silver halide color photographic material in which the bleaching bath can be easily reused.

The above objects of this invention can be achieved by processing an imagewise exposed and color developed silver halide color photographic material with a solution containing a ferric ion complex, a bromate and a water-soluble chloride.

U.S. Pat. No. 3,770,437 teaches a bleaching bath comprising a ferric complex of aminopolycarboxylic acid, a bromate and an iodide or bromide. In accordance with this teaching, the bleaching bath was investigated using the bromide. As pointed out, the bleaching bath immediately after preparation converted the leuco product into a dye. It was found, however, that upon standing the oxidizing power of the bleaching bath abruptly decreased and the oxidation of the leuco product became insufficient. Moreover, upon treatment immediately after preparation, magenta stain occurred. It was also noted that immediately after preparation the bleaching bath always smelled of bromine and was likely to affect humans adversely. When the iodide was used instead of the bromide, poor fixation occurred, and it was difficult to remove the developed silver. In other words, while a bleaching bath containing a bromide or iodide has a satisfactory bleaching ability, it suffers from serious defects in actual applications.

Investigations were made using a chloride which is not generally used in this art. Surprisingly, these investigations led to the present invention and the discovery that the bleaching agent did not decrease in activity even upon standing, no magenta stain was formed, and the removal of the developed silver was complete. Generally, the water-soluble halide used in a bleaching bath is a bromide or iodide. In a rare case, a chloride has been used in a ferric chloride bleaching bath. However, in a bleaching agent containing an iron complex of aminopolycarboxylic acid as in the present invention, the bormide or iodide are conventionally used together. It is known to those skilled in the art that the use of a chloride reduces the bleaching activity of the bleaching bath due to the high silver potential. However, in the co-presence of a bromate, the result is contrary to what one might except from conventional knowledge. In other words, although the present invention resulted from the mere substitution of a chloride for the bromide of the known bromate-containing bleaching agent, the result obtained is quite unexpected.

With a negative photographic material containing the aforesaid high sensitive emulsion, bleaching ends within a relatively short period of time. However, with a reversal photographic material the bleaching time required is longer than with the negative photographic material because the amount of developed silver is larger. Another finding which underlies this invention is that the bleaching time in this case can be successfully shortened by adding an aliphatic carboxylic acid such as acetic acid, succinic acid or malonic acid, an aliphatic phosphonic acid such as 2,2-diphosphonoethanol, or an aliphatic phosphonocarboxylic acid such as 2-phosphono-1,2,4-tricarboxylic acid.

Although the addition of an aliphatic carboxylic acid to a bleaching bath has long been known, according to the present invention the effect of the addition is very great when it is used together with the bromate. This is an evident difference over the prior art.

Japanese Patent Application (OPI) No. 29719/78 discloses a method of photographic processing in which a solution containing a metal complex of an aminopolycarboxylic acid and a halogen ion and a solution containing a bromate are separately used. In the present invention, a solution containing a ferric ion complex, a bromate and a chloride together is used, which makes the present invention evidently different from the method disclosed in Japanese Patent Application (OPI) No. 29719/78.

DETAILED DESCRIPTION OF THE INVENTION

The ferric ion complex used in this invention is a complex of a ferric ion and a chelating agent such as an aminopolycarboxylic acid, an aminopolyphosphonic acid or salts thereof. The aminopolycarboxylic acid salt or aminopolyphosphonic acid salt is a salt formed between an aminopolycarboxylic acid or aminopolyphosphonic acid and an alkali metal, ammonium or a water-soluble amine. Examples of the alkali metal are sodium, potassium, lithium and so on. Examples of the water-soluble amine include alkylamines such as methylamine, diethylamine, triethylamine and butylamine, alicyclic amines such as cyclohexylamine, arylamines such as aniline and m-toluidine, and heterocyclic amines such as pyridine, morpholine and piperidine.

Typical examples of the chelating agent such as the aminopolycarboxylic acid, aminopolyphosphonic acid or the salts thereof include:

Ethylenediaminetetraacetic acid,
Disodium ethylenediaminetetraacetate,
Diammonium ethylenediaminetetraacetate,
Tetra(trimethylammonium)ethylenediaminetetraacetate,
Tetrapotassium ethylenediaminetetraacetate,
Tetrasodium ethylenediaminetetraacetate,
Trisodium ethylenediaminetetraacetate,
Diethylenetriaminepentaacetic acid,
Pentasodium diethylenetriaminepentaacetate,
Ethylenediamine-N-(β-oxyethyl)-N,N',N'-triacetic acid,
Sodium ethylenediamine-N-(β-oxyethyl)-N,N',N'-triacetate,
Triammonium ethylenediamine-N-(β-oxyethyl)-N,N',N'-triacetate,
Propylenediaminetetraacetic acid,
Sodium propylenediaminetetraacetate,
Nitrilotriacetic acid,
Sodium nitrilotriacetate,
Cyclohexanediaminetetraacetic acid,
Sodium cyclohexanediaminetetraacetate,
Iminodiacetic acid,
Dihydroxyethylglycine,
Ethyletherdiaminetetraacetic acid,
Glycoletherdiaminetetraacetic acid,
Ethylenediaminetetrapropionic acid,
Phenylenediaminetetraacetic acid,
1,3-Diaminopropanol-N,N,N',N'-tetramethylenephosphonic acid,
1,3-Propylenediamine-N,N,N',N'-tetramethylenephosphonic acid.

Needless to say, the invention is not limited to these examples.

The ferric ion complex may be used as such, or formed in situ in solution using a ferric salt such as ferric sulfate, ferric chloride, ferric nitrate, ferric ammonium sulfate or ferric phosphate and a chelating agent such as an aminopolycarboxylic acid or aminopolyphosphonic acid. In the case of the former, one or more complex salts may be used. When the complex salt is formed in situ using the ferric salt and chelating agent, one or more of the ferric salts may be used, and one or more chelating agents may be used. In either case, the chelating agent may be used in an amount exceeding that required for the formation of the ferric complex.

The amount of the ferric ion complex is about 0.05 to 2 mols and preferably about 0.1 to 0.5 mol per liter of the bleaching bath.

The bromate that can be used in this invention is an alkali metal salt or ammonium salt of bromic acid. The alkali metal is, for example, sodium or potassium. Sodium bromate is especially preferred because of its solubility. $Ca(BrO_3)_2$, $Ce(BrO_3)_3$, and $Co(BrO_3)_2$ can also be used.

The amount of the bromate is not overly restricted. Amounts of about 0.005 to about 0.5 mol, preferably 0.05 to 0.3 mol and more preferably 0.1 to 0.2 mol per liter of the bleaching bath are used.

Examples of the water-soluble chloride that can be used in this invention are alkali metal (sodium, potassium, etc.) chlorides and ammonium chlorides. $R_4NCl$, $FeCl_3.6H_2O$, etc., wherein R represents an alkyl group having 1 to 4 carbon atoms, can also be used. Ammonium chloride is preferred. The amount of the chloride is not critical, but is about 0.1 to about 7 mols, preferably 0.5 to 4 mols, most preferably 1 to 3 mols, per liter of the bleaching bath.

The aliphatic carboxylic acid, aliphatic phosphonic acid or aliphatic phosphonocarboxylic acid used as a bleaching promotor in this invention include compounds capable of releasing an aliphatic carboxylic acid, aliphatic phosphonic acid or aliphatic phosphonocarboxylic acid in aqueous solution. The aliphatic acid preferably has 1 to 6 carbon atoms. Examples of the aliphatic carboxylic acid are acetic acid, acetate salts, succinic acid, succinate salts, malonic acid, malonate salts, citric acid, and citrate salts. Maleic acid, citraconic acid, acrylic acid, etc., are examples of unsaturated acids which can be used. Examples of the aliphatic phosphonic acid are 2,2-diphosphonoethanol, and salts thereof. The aliphatic phosphonocarboxylic acid preferably has 5 to 12 carbon atoms such as 2-phosphono-1,2,4-tricarboxylic acid. Salts of these are, for example, alkali metal (sodium, potassium, etc.) and ammonium salts. These are merely illustrative and the invention is not limited to these specific compounds. The amount of the bleaching promotor is generally about 0.5 to about 5 mols and preferably about 0.2 to 1 mol per liter of the bleaching bath. While the bleach promotor is generally used in the bleach bath, it can be used in a separate bath before the bleaching step.

The pH of the bleaching bath should be maintained at about 2 to 8, preferably at about 4 to 7, and it is used at 20° to 60° C., preferably about 30° to 50° C.

The bleaching bath may also contain conventional additives, for example, corrosion inhibitors such as ammonium sulfate, swelling inhibitors such as surface active agents, and pH adjusting agents such as sodium hydroxide and ammonia water.

In processing a silver halide color photographic material using the method of this invention, a substituted alkylthiol compound or its precursor may be added as a bleach promoting agent to a bath used before the bleaching step. Typical examples of the substituted alkylthiol compound or its precursor are described in U.S. Pat. No. 3,893,858, *Research Disclosure,* 15704 (May 1977), and Japanese Patent Application (OPI) Nos. 20832/77, 32736/78, 94927/78, 95630/78 and 95631/78.

The substituted alkylthiol compound or its precursor which may be used in this invention may be represented by the following general formula:

$$R—S—Y$$

wherein R represents a substituted alkyl group containing 1 to 8 carbon atoms, which may be branched, at least one of the substituents of R being selected from the group consisting of a hydroxy group, a primary, secondary or tertiary amino group, a carboxyl group, a sulfone group, a piperidino group, a pyrrolyl group, a morpholino group and an imidazole group; and Y represents a hydrogen atom or an amidino group.

Specific examples of this compound are shown below.

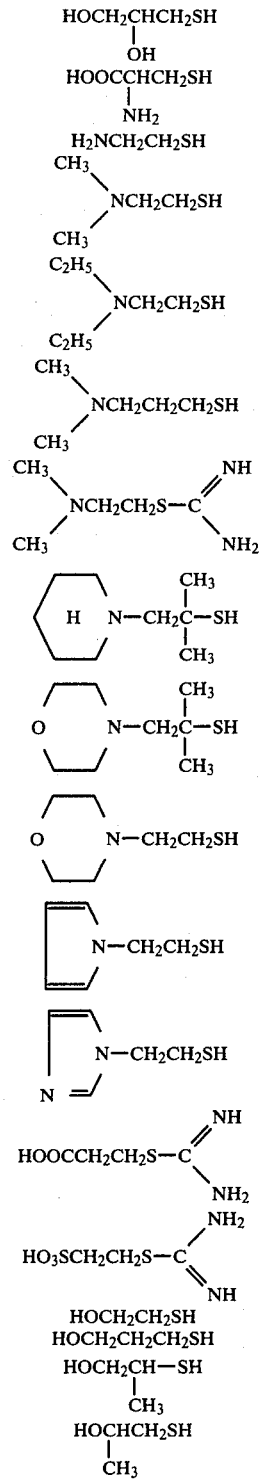

These compounds may be used in the form of a salt such as a hydrochloride. While those listed above are representative only and are not limitative, 2-mercaptoethanol, thioglycerol and N,N-dimethylaminoethanethiol are particularly preferred. The amount of such a compound is preferably about $1\times10^{-5}$ mol/liter to 1 mol/liter and more preferably $1\times10^{-3}$ mol/liter to $1\times10^{-1}$ mol/liter.

These alkylthio compounds may be contained in a color developing bath and processing solutions provided after the color developing bath and before the bleaching bath. For example, these processing solutions include a color developing bath, a stop bath, and a stop-fixation bath. When the photographic material is treated with a bath containing the substituted alkylthiol compound or its precursor before bleaching treatment with a bleaching solution containing a ferric complex salt, a bromate and a chloride, the bleaching time is very much shortened.

The bleaching bath in accordance with this invention can be easily reused by a conventional technique, for example, by blowing air therethrough or adding hydrogen peroxide.

The present invention is applicable to all color photographic materials containing silver halide such as color papers, color negative films, color reversal films, and color positive films. It is especially effective when used to process photographic materials comprising a silver halide emulsion layer having a total silver content as high as at least about 30 mg per 100 $cm^2$. Advantageously, it is used to process photographic materials having a total silver content of at least about 40 mg per 100 $cm^2$.

In the method of this invention, processing an iamgewise exposed color negative film, color positive film, color paper, etc., is usually based on one of the following sequences.

(1) Color development→stopping→bleaching→washing→fixation→washing→stabilization→drying.

(2) Color development→stopping→bleaching→fixation→washing→stabilization→drying.

(3) Color development→stopping-fixation→bleaching→fixation→washing→stabilization→drying.

In sequence (1), (2) or (3), a pre-bath or a hardening bath may be provided before the color development, and the stabilizing bath or washing, etc., after bleaching may be omitted.

On the other hand, the step of treating a color reversal film is usually based on one of the following sequences.

(4) Black-and-white development→stopping→washing→fogging→washing→color development→stopping→washing→bleaching→washing→fixation→washing→stabilization→drying.

(5) Color development→bleaching→washing→fixation→washing→stabilization→drying→color development→bleaching→fixation→washing→drying.

(6) Black-and-white development→stopping→washing→fogging→washing→color development→stopping→washing→bleaching→fixation→washing→stabilization→drying.

In sequences (4) and (6), a pre-bath, a pre-hardening bath, a neutralizing bath, etc., may be provided, and the stabilizing bath and the washing, etc., after bleaching may be omitted. The fogging bath may be replaced by re-exposure, or the fogging bath may be omitted by adding a fogging agent to a color developer solution.

In the photographic processing method of this invention, the sequences shown in (1) to (6) are useful, but the invention is not limited thereto.

The color developer solution used in this invention has a general composition of a color developer containing an aromatic primary amine developing agent. Examples of preferred aromatic primary amine color developing agents are p-phenylenediamine derivatives such as N,N-diethyl-p-phenylenediamine, 2-amino-5-diethylaminotoluene, 2-amino-5-(N-ethyl-N-laurylamino)toluene, 4-[N-ethyl-N-(β-hydroxyethyl-)amino]aniline, 2-methyl-4-[N-ethyl-N-(β-hydroxyethyl)amino]aniline, N-ethyl-N-(β-methanesulfonamidoethyl)-3-methyl-4-aminoaniline as described in U.S. Pat. No. 2,193,015, N-(2-amino-5-diethylaminophenylethyl)-methanesulfonamide and N,N-dimethyl-p-phenylenediamine as described in U.S. Pat. No. 2,592,364, 4-amino-3-methyl-N-ethyl-N-methoxyethylaniline, 4-amino-3-methyl-N-ethyl-N-β-ethoxyethylaniline and 4-amino-3-methyl-N-ethyl-N-β-butoxyethylaniline as described in U.S. Pat. Nos. 3,656,950 and 3,698,525, and the salts thereof (e.g., sulfate, hydrochloride, sulfite, p-toluenesulfonate, etc.).

The color developer solution may contain other known developer ingredients. For example, as an alkali agent or a buffer, sodium hydroxide, potassium hydroxide, sodium carbonate, potassium carbonate, sodium tertiary phosphate, potassium tertiary phosphate, potassium metaborate, and borax may be used either singly or in combination with one another. Furthermore, to impart buffering properties or increase the ionic strength or for the convenience of formulation, there may be used various salts in addition to the aforesaid additives. Examples of the salts are disodium or dipotassium hydrogen phosphate, potassium or sodium dihydrogen phosphate, sodium or potassium bicarbonate, boric acid, alkali metal nitrates, alkali metal sulfates, etc.

If desired, any desired development promoter can be added to the color developer solution. There can be used, for example, various pyridinium compounds, other cationic compounds, cationic dyes such as phenosafranine and neutral salts such as thallium nitrate or potassium nitrate which are typically as disclosed in U.S. Pat. Nos. 2,648,604 and 3,671,247 and Japanese Patent Publication No. 9503/69, polyethylene glycol, its derivatives, and nonionic compounds such as polythioethers which are disclosed in Japanese Patent Publication No. 9504/69 and U.S. Pat. Nos. 2,533,990, 2,531,832, 2,950,970 and 2,577,127, organic solvents and organic amines (such as ethanolamine, ethylenediamine, or diethanolamine), etc., disclosed in Japanese Patent Publication No. 9509/69 and Belgian Patent 682,862, and the promotors disclosed at pages 40 to 43 of L.F.A. Mason, *Photographic Processing Chemistry* (Focal Press, London, 1966). Other useful development promotors include benzyl alcohol as and phenylethyl alcohol described in U.S. Pat. No. 2,515,147, and pyridine, ammonia, hydrazine, and amines as described in the *Journal of Japanese Society of Photography*, Vol. 14, page 74 (1952).

Furthermore, sulfites such as sodium sulfite or potassium sulfite, potassium bisulfite, sodium bisulfite, hydroxylamine, ascorbic acid, pentose, and hexose, which are usually employed as preservatives, can also be added.

If required, an antifogging agent may be added to the color developer solution. Examples are alkali metal halides such as potassium bromide, sodium bromide and potassium iodide, and organic antifogging agents. Specific organic antifogging agents are nitrogen-containing heterocyclic compounds such as benzotriazole, 6-nitrobenzimidazole, 5-nitroisoindazole, 5-methylbenzotriazole, 5-nitrobenzotriazole and 5-chlorobenzotriazole, mercapto-substituted heterocyclic compounds such as 1-phenyl-5-mercaptotetrazole, 2-mercaptobenzimidazole and 2-mercaptobenzothiazole, and mercapto-substituted aromatic compounds such as thiosalicyclic acid. The nitrogen-containing heterocyclic compounds are preferred. In particular, nitrogen-containing heterocyclic compounds not substituted with mercapto are preferred. The amount of the antifogging agent is about 1 mg to 5 g, preferably about 5 mg to 1 g per liter of the color developer solution.

Furthermore, polyphosphoric acid compounds typified by sodium hexametaphosphate, sodium tetrapolyphosphate, sodium tripolyphosphate or the corresponding potassium salts of the aforesaid polyphosphoric acids, and aminopolycarboxylic acids typified by phosphonocarboxylic acid, α-aminoacids, ethylenediaminetetraacetic acid, nitrilotriacetic acid, cyclohexanediaminetetraacetic acid, iminodiacetic acid, N-hydroxymethylethylenediaminetriacetic acid and diethylenetriaminepentaacetic acid can be used as water softening agents. The amount of the water softening agent differs according to the degree of hardness of the water used, but usually it is in the range of about 0.5 to about 1 g/liter.

Other calcium and magnesium masking agents can also be used in the photographic processing solutions. They are described in detail in J. Willems, *Belgische Chemische Industrie*, Vol. 21, page 325 (1956) and Vol. 23, page 1105 (1958).

In the case of processing a reversal color photographic material, competing couplers, fogging agents and compensating developing agents may be added to the color developer solution.

Citrazinic acid, J acid (2-amino-5-naphthol-7-sulfonic acid), and H acid (1-amino-8-naphthol-3,6-disulfonic acid) are examples of useful competing couplers. For example, those compounds described in U.S. Pat. Nos. 2,742,832, 3,520,690, 3,560,212 and 3,645,737 and Japanese Patent Publication Nos. 9504/69, 9506/69 and 9507/69 can be used.

Examples of the fogging agent that can be used are alkali metal borohydrides such as sodium borohydride, amineboranes such as t-butylamineborane, tin-aminopolycarboxylic acid complexes, a tin-pyrophosphoric acid complex, a tin-tetrapolyphosphoric acid complex, a tin-hexametaphosphoric acid complex, and ethylenediamine. The compounds described in Japanese Patent Publication No. 38816/72 are also useful.

Examples of the compensating developer are p-aminophenol, N-benzyl-p-aminophenol, and 1-phenyl-3-pyrazolidone. The compounds described in Japanese Patent Publication Nos. 41475/70 and 19037/71 are also useful.

The pH of the color developer solution is within the range of about 7 to about 14, preferably about 8 to about 13.

The processing method of this invention can be applied to a color photographic process in which a color-forming coupler is included in a photographic material, for example, the methods disclosed in U.S. Pat. Nos. 2,322,027, 2,376,679, and 2,801,171, and to a color photographic process in which a color-forming agent is included in a developer, for example, the methods described in U.S. Pat. Nos. 2,252,718, 2,590,970 and 2,592,243. However, the former method is mainly carried out. When a color-forming coupler is to be included in a photographic material, the photographic material used is generally a multilayer photographic material. It is desirable that the coupler remain in a fixed layer and should not diffuse to other layers during manufacture, storage and processing.

The fixation bath may be of a general composition. Examples of a fixing agent are thiosulfate salts, thiocyanate salts, thioureas, thioglycols, and water-soluble organic diols containing sulfur and oxygen in the molecule such as 3,6-dithia-1,8-octyldiol. In addition to the fixing agent, the fixing bath may contain stabilizers such as sulfites (e.g., sodium sulfite) (the use of a stabilizer is preferred especially when a thiosulfate is used as the fixing agent), pH-buffering salts, or swelling-inhibiting salts (for example, a hardening agent such as potassium alum).

A black-and-white developer used in a silver dye bleaching process or a reversal color photographic process may contain developing agents that are generally used. Examples of the developing agents are dihydroxybenzenes (e.g., hydroquinone, or sodium hydroquinone monosulfonate), 3-pyrazolidones (e.g., 1-phenyl-3-pyrazolidone), aminophenols (e.g., N-methyl-p-aminophenol), ascorbic acid, etc. These developing agents are used either singly or in combination with each other. The developer further contains a preservative, an alkali agent, a pH buffer and an anti-fogging agent, and if further required, a dissolving adjuvant, a toning agent, a developing promotor, a surface active agent, an antifoamer, a water softening agent, a hardening agent, a tackiness-imparting agent, etc. (the details of these additives are well known in the art).

The photographic emulsion layer of a photographic material used in this invention may contain a color-forming coupler, i.e., a compound which reacts with the oxidation product of an aromatic amine (usually a primary amine) developing agent to form a color (to be referred to as a coupler). Desirably, the coupler is non-diffusible and contains a hydrophobic group called a ballast group. The coupler may be 2-equivalent or 4-equivalent to a silver ion. It may also contain a colored coupler having an effect of color correction, or a coupler capable of releasing a developing inhibitor with the progress of development (so-called DIR coupler). A coupler which gives a colorless product by coupling reaction may also be used.

As a yellow-forming coupler, known couplers of the open ketomethylene type can be used. Of these, benzoyl acetanilide type and pivaloyl acetanilide type compounds are advantageous. Specific examples of usable yellow-forming couplers are described, for example, in U.S. Pat. Nos. 2,875,057, 3,265,506, 3,408,194, 3,551,155, 3,582,322, 3,725,072 and 3,891,445, German Pat. No. 1,547,868, German Patent Application (OLS) Nos. 2,219,917, 2,261,361 and 2,414,006, British Pat. No. 1,425,020, Japanese Patent Publication No. 10783/76, and Japanese Patent Application (OPI) Nos. 26133/72, 73147/73, 102636/76, 6341/75, 123342/75, 130442/75, 21827/76, 87650/75, 82424/77 and 115219/77.

Pyrazolone-type compounds, indazolone-type compounds, and cyanoacetyl compounds can be used as magenta-forming couplers. The pyrazolone-type compounds are especially advantageous. Specific examples of usable magenta-forming couplers are described, for example, in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, German Pat. No. 1,810,464, German Patent Application (OLS) Nos. 2,408,665, 2,417,945, 2,418,959, and 2,424,467, Japanese Patent Publication Nos. 6031/65 and 45990/76, and Japanese Patent Application (OPI) Nos. 20826/76, 58922/77, 129538/74, 74027/74, 159336/75, 42121/77, 74028/74, 60233/75, 26541/76 and 55122/78.

As cyan-forming couplers, phenolic compounds and naphthol-type compounds can be used. Specific examples of these couplers are described, for example, in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411 and 4,004,929, German Patent Application (OLS) Nos. 2,414,830 and 2,454,329, Japanese Patent Application (OPI) Nos. 59838/73, 26034/76, 5055/73, 146828/76, 69624/77 and 90932/77.

Examples of colored couplers that can be used are those described in U.S. Pat. Nos. 3,476,560, 2,521,908 and 3,034,892, Japanese Patent Publication Nos. 2016/69, 22335/63, 11304/67 and 32461/69, Japanese Patent Application (OPI) Nos. 26034/76 and 42121/77, and German Patent Application (OLS) No. 2,418,959.

Examples of usable DIR couplers are those described in U.S. Pat. Nos. 3,227,554, 3,617,291, 3,701,783, 3,790,384, and 3,632,345, German Patent Application (OLS) Nos. 2,414,006, 2,454,301 and 2,454,329, British Pat. No. 953,454, Japanese Patent Application (OPI) Nos. 122335/74 and 69624/77, and Japanese Patent Publication No. 16141/76.

In addition to the DIR coupler, a compound which releases a developing inhibitor with the progress of development may be included in the photographic material. For example, the compounds described in U.S. Pat. Nos. 3,297,445 and 3,379,529, German Patent Application (OLS) No. 2,417,914 and Japanese Patent Application (OPI) Nos. 15271/77 and 9116/77 can be used.

To meet the characteristics required of the photographic material, two or more of the aforesaid couplers, etc., may be used in the same layer. It is also permissible to add the same coupler to two or more different layers.

Generally, the coupler is dispersed in a photographic silver halide emulsion layer together with a solvent having suitable polarity. Useful solvents include tri-o-cresyl phosphate, trihexyl phosphate, dioctylbutyl phosphate, dibutyl phthalate, diethyllaurylamide, 2,4-diallylphenol, and octyl benzoate.

An azo dye is one typical example of a color image-forming substance in a silver dye bleaching photographic material to be processed by the present invention.

The color photographic material to be processed by the method of this invention comprises a support and at least one silver halide emulsion layer on the support. Usually, the photographic material has a red-sensitive silver halide emulsion layer, a green-sensitive silver halide emulsion layer and a blue-sensitive silver halide emulsion layer on the support. Stated in more detail, the photographic material usually has at least one red-sensitive silver halide emulsion layer containing a cyan image-forming coupler, at least one green-sensitive silver halide emulsion layer containing a magenta image-forming coupler, and at least one blue-sensitive silver halide emulsion layer containing a yellow image-forming coupler. Such a photographic element may include a non-light-sensitive photographic layer (e.g., an antihalation layer, an intermediate layer for preventing color mixing, a yellow filter layer, a protective layer, etc.). The order of arrangement of the red-sensitive layer, the green-sensitive layer and the blue-sensitive layer is not particularly limited. There can be used photographic silver halide emulsions of the surface latent image type or internal latent image type which are produced by conventional techniques.

As stated in detail hereinabove, there is no particular restriction on the method of manufacture of the silver halide emulsion of the photographic material used in this invention, the construction of the layers of the photographic material, photographic additives, materials used for photography, photographic processing solutions, etc.

By applying the bleaching method of this invention, the following advantages can be obtained.

(1) Environmental pollution can be reduced.
(2) The rate of bleaching is fast.
(3) No stain occurs.
(4) Poor color reproduction in which a dye formed in the developing step remains as a leuco dye even after the end of the bleaching step is avoided.
(5) The bleaching bath always retains stable bleaching ability.
(6) The bleaching agent can be reused.

The following Examples illustrate the present invention in greater detail.

COMPARISON EXAMPLE 1

The following color reversal photographic material was produced by coating the following layers on a triacetate film base.

First Layer (red-sensitive emulsion layer)

Coating composition: A red-sensitive silver iodobromide emulsion (silver iodide: 7 mol%) and a cyan coupler emulsion (containing 1-hydroxy-4-chloro-2-n-dodecylnaphthamide as a cyan coupler and dibutyl phthalate as a coupler solvent) were mixed so that the silver/coupler molar ratio became 8.0.

Amount of silver coated: 1.5 g $Ag/m^2$

Second Layer (intermediate layer)

A gelatin intermediate layer having di-t-amyl hydroquinone dispersed therein.

Third Layer (green-sensitive emulsion layer)

Coating composition: A green-sensitive silver iodobromide (silver iodide: 6 mol%) and a magenta coupler emulsion containing 1-(2,4,6-trichlorophenyl)-3-[3-(2,4-di-t-amylphenoxyacetamido)benzamido]-5-pyrazolone as a magenta coupler and tricresyl phosphate as a coupler solvent were mixed so that the silver/coupler molar ratio became 9.5.

Amount of silver coated: 1.5 g $Ag/m^2$

Fourth Layer (yellow filter layer)

A filter layer composed of yellow colloidal silver and gelatin.

Fifth Layer (blue-sensitive emulsion layer)

Coating composition: A blue-sensitive silver iodobromide emulsion (silver iodide: 6 mol%) and a yellow coupler emulsion containing α-pivaloyl-2-chloro-5-[γ-(2,4-di-t-amylphenoxy)butanamido]acetanilide as a yellow coupler and dibutyl phthalate as a solvent for the coupler were mixed so that the molar ratio of silver/coupler was 8.0.

Amount of silver coated: 1.8 g $Ag/m^2$

Sixth Layer (protective layer)

A protective layer composed mainly of gelatin.

The resulting color reversal film was exposed through an optical wedge for 1/100 second from a tungsten lamp as a light source, and then subjected to the following reversal processing.

| Processing Step | Temperature (°C.) | Time |
|---|---|---|
| First Development (black-and-white) | 43 | 2 minutes |
| Stopping | 40 | 20 seconds |
| Washing | 40 | 40 seconds |
| Color Development | 46 | 2 minutes |
| Stopping | 40 | 20 seconds |
| Washing | 40 | 1 minute |
| Bleaching | 40 | 1.5 minutes |
| Fixation | 40 | 40 seconds |
| Washing | 40 | 1 minute |
| Stabilization | 40 | 20 seconds |
| Drying | 37 | |

Formulation of the First Developer Solution

Sodium Sulfite—60.0 g
1-Phenyl-3-pyrazolidone—0.3 g
Hydroquinone—5.0 g
Sodium Carbonate Monohydrate—41.0 g
Potassium Bromide—2.0 g
Potassium Iodide (1% aq. soln.)—1.0 ml
Potassium Thiocyanate (1 N aq. soln.)—10.0 ml
Sodium Hydroxide (10% aq. soln.)—2.0 ml
Water to make—1.0 l Composition of the Stop Bath Sodium Acetate—30 g
Glacial Acetic Acid—8 ml
Water to make—1 l Formulation of the Color Developer Benzyl Alcohol—5.0 ml
Sodium Hydroxide—0.5 g
Diethylene Glycol—3.0 ml
Sodium Hexametaphosphate—2.0 g
Sodium Sulfite—2.0 g
Potassium Bromide—2.0 g
Ethyl-N-(β-methanesulfonamidoethyl)-aniline Sesquisulfate Monohydrate—9.0 g
Citrazinic Acid—0.4 g
Metaboric Acid—0.5 g
Sodium Metaborate Tetrahydrate—77.0 g
Sodium Borohydride—0.1 g
Water to make—1 l Formulation of the Bleaching Solution Bleaching Solution-1

Potassium Ferricyanide—50 g
Potassium Bromide—25 g
Sodium Primary Phosphate—1 g
Water to make—1 l Formulation of the Fixation Bath Sodium Thiosulfate—200 g
Sodium Sulfite—15 g
Borax—12 g
Glacial Acetic Acid—15 ml
Water to make—1 l Formulation of the Stabilizer Solution Formalin (37%)—10 cc
Fuji Drywell—5 cc
Water to make—1 l

COMPARISON EXAMPLE 2

In the processing steps of Comparison Example 1, the bleaching time and the formulation of the bleaching bath were changed as follows:

Bleaching Time: 30, 45, 60, 90, 120. and 180 seconds.

Formulation of the Bleaching Bath

Bleaching Solution-2

Disodium Ethylenediaminetetraacetate—10 g
Ferric Ammonium Ethylenediaminetetraacetate Dihydrate—170 g
Ammonium Bromide—300 g
Potassium Bromate—5 g
Water to make—1 l
pH—5.0

The bleaching solution-2 resulted from the addition of disodium ethylenediaminetetraacetate as a precipitation inhibitor for a ferric ion to a known formulation.

EXAMPLE 1

In the processing steps of Comparison Example 1, the bleaching time was changed as in Comparison Example 2, and the composition of the bleaching solution was changed as follows:

Formulation of the Bleaching Bath

Bleaching Solution-3 (bleaching solution within the scope of this invention)

Disodium Ethylenediaminetetraacetate—10 g
Ferric Ammonium Ethylenediaminetetraacetate—170 g
Ammonium Chloride (nearly equimolar to the ammonium bromide used in the bleaching solution-2)—150 g
Potassium Bromate—5 g
Water to make—1 l
pH—5.0

EXAMPLE 2

The bleaching time was the same as in Comparison Example 2, and the bleaching solution used was prepared by adding 50 ml of glacial acetic acid to the bleaching solution-3 and further adding ammonia water (28% by weight) to adjust the pH of the solution to 5.0.

EXAMPLE 3

The bleaching time was the same as in Comparison Example 2, and the bleaching solution used was prepared by adding 85 g of malonic acid to the bleaching solution-3, and further adding ammonia water (28% by weight) to adjust the pH of the solution to 5.0.

EXAMPLE 4

The bleaching time was the same as in Comparison Example 2, and the bleaching solution used was prepared by adding 150 ml of 55% 2-phosphonobutane-1,2,4-tricarboxylic acid, and further adding ammonia water (28% by weight) to adjust the pH of the solution to 5.0.

TEST PROCEDURE 1

As photographic characteristics obtained by the processing in Comparison Examples 1 and 2 and Examples 2 to 4, the bleach completing time, the total amounts of residual silver in the maximum density portion and in the minimum density portion, and the maximum and minimum densities are shown in Table 1.

In Comparison Example 1, however, the bleaching time was adjusted to 1.5 minutes which was about twice as much as the bleach completing time in order to prepare a standard sample having a minimum of the amount of residual silver.

TABLE 1

| Example | Bleach Time (seconds) | Total Amount of Residual Silver: At the Maximum Density Portion ($\mu g/cm^2$) | Total Amount of Residual Silver: At the Minimum Density Portion ($\mu g/cm^2$) | Minimum Density: Yellow | Minimum Density: Magenta | Minimum Density: Cyan | Maximum Density: Yellow | Maximum Density: Magenta | Maximum Density: Cyan |
|---|---|---|---|---|---|---|---|---|---|
| C-1 (std.) | 90 | 5.0 | 3.0 | 0.12 | 0.12 | 0.12 | 3.00 | 2.72 | 2.93 |
| C-2 | 30 | 5.3 | 3.1 | 0.36 | 0.40 | 0.16 | 2.78 | 2.63 | 2.89 |
| 1 | 120 | 5.2 | 3.0 | 0.12 | 0.12 | 0.12 | 2.98 | 2.70 | 2.91 |
| 2 | 60 | 5.1 | 3.1 | 0.13 | 0.12 | 0.12 | 2.99 | 2.72 | 2.92 |
| 3 | 90 | 5.0 | 3.0 | 0.12 | 0.12 | 0.12 | 2.98 | 2.72 | 2.92 |
| 4 | 90 | 5.4 | 3.2 | 0.13 | 0.13 | 0.12 | 2.98 | 2.72 | 2.92 |

The bleach time, as referred to herein, denotes the time at which the total amount of residual silver measured at each bleaching time described in Comparison Example 2 became substantially the same as the standard (Comparison Example 1).

It can be seen from the results shown in Table 1 that in Comparison Example 2, the bleach time is the shortest, but the minimum density was higher than the standard, and the occurrence of stain was observed, and the maximum density was lower than the standard, and it is presumed that partial destruction of the dye advanced.

On the other hand, in Examples 1 to 4 in which the chloride was used in accordance with the present invention, the bleach time was longer than in the case of using the bleaching solution-2, but the minimum and maximum densities were almost the same as in the case of the standard.

Furthermore, when acetic acid, malonic acid or 2-phosphonobutane-1,2,4-tricarboxylic acid was added (Examples 2 to 4), the bleach time was shortened as compared with the case of adding no such compound. This shows that these compounds have the effect of promoting bleaching.

TEST PROCEDURE 2

The bleaching solutions prepared as in Comparison Examples 1 and 2 and Examples 1 to 4 were allowed to stand for a week at 40° C. The photographic characteristics at such time are shown in Table 2.

TABLE 2

| Example | Bleach Time (seconds) | Total Amount of Residual Silver: At the Maximum Density Portion ($\mu g/cm^2$) | Total Amount of Residual Silver: At the Minimum Density Portion ($\mu g/cm^2$) | Minimum Density: Yellow | Minimum Density: Magenta | Minimum Density: Cyan | Maximum Density: Yellow | Maximum Density: Magenta | Maximum Density: Cyan |
|---|---|---|---|---|---|---|---|---|---|
| C-1 (std.) | 90 | 5.1 | 3.2 | 0.12 | 0.12 | 0.12 | 3.01 | 2.72 | 2.94 |
| C-2 | 180 | 5.2 | 3.2 | 0.34 | 0.38 | 0.15 | 2.80 | 2.64 | 2.90 |
| 1 | 120 | 5.2 | 3.1 | 0.12 | 0.12 | 0.12 | 2.99 | 2.71 | 2.92 |
| 2 | 60 | 5.1 | 3.2 | 0.12 | 0.12 | 0.12 | 3.00 | 2.72 | 2.94 |
| 3 | 90 | 5.2 | 3.1 | 0.12 | 0.12 | 0.12 | 2.99 | 2.72 | 2.93 |
| 4 | 90 | 5.3 | 3.2 | 0.13 | 0.12 | 0.12 | 2.99 | 2.72 | 2.93 |

It can be seen from the results shown in Table 2 that in Comparison Example 2, in which the bromide was used, the bleach time was retarded and the minimum density of magenta was high, showing that the maximum density of magenta was low with the occurrence of stain. This is presumably because of the instability of the bromate ion and the generation of active bromine.

EXAMPLE 5

As alkylthiols, compound (1), the dihydrochloride of compound (7), and compound (14) exemplified hereinabove were each added in an amount of $2\times10^{-2}$ mol/liter to the stop bath (containing 15 g/liter of sodium sulfite as a stabilizer for the promoter), and, using the bleaching solution used in Example 1, the processing was performed using the bleaching time shown in Comparison Example 2.

The results obtained are shown in Table 3.

TABLE 3

| Added Alkylthiol Compound | Bleach Time (seconds) | Amount of Residual Silver: Maximum Density Portion ($\mu g/cm^2$) | Amount of Residual Silver: Minimum Density Portion ($\mu g/cm^2$) |
|---|---|---|---|
| (1) | 60 | 5.1 | 3.0 |
| Dihydrochloride of (7) | 45 | 5.0 | 3.0 |
| (14) | 45 | 5.1 | 3.0 |

All three alkylthiol compounds shortened the bleaching time. Furthermore, the maximum and minimum densities were almost the same as the results obtained in Example 2.

When the bleaching solution used in Example 5 was allowed to stand for a week at 40° C., the same good performance as above was exhibited.

EXAMPLE 6

As alkylthiols, compound (1), the dihydrochloride of compound (7), and compound (14) exemplified hereinabove were each added in an amount of $2\times10^{-2}$ mol/liter to the stop bath (having the same formulation as the solution used in Example 5), and, using the bleaching solution used in Example 2, the processing was performed by employing the same bleaching time as in Comparison Example 2.

The results obtained are shown in Table 4.

TABLE 4

| Added Alkylthiol Compound | Bleach Time (seconds) | Amount of Residual Silver: Maximum Density Portion ($\mu g/cm^2$) | Amount of Residual Silver: Minimum Density Portion ($\mu g/cm^2$) |
|---|---|---|---|
| (1) | 45 | 5.2 | 3.0 |
| Dihydrochloride of (7) | 30 | 5.0 | 3.0 |
| (14) | 30 | 5.1 | 3.0 |

It can be seen from a comparison of the above results with the results of the above Examples that the bleaching solution and the processing shown in Example 6 produced the greatest effect.

The maximum and minimum densities and the results with respect to the standing of the bleaching solution were the same as those shown in Example 5.

While the invention has been described in detail and with reference to specific embodiments thereof, it will be apparent to one skilled in the art that various changes and modifications can be made therein without departing from the spirit and scope thereof.

What is claimed is:

1. A method which comprises processing an imagewise exposed and color developed silver halide color photographic material with a solution containing a ferric ion complex, a bromate and a water-soluble chloride.

2. The method of claim 1, wherein said solution contains about 0.05 to 2 mol/l ferric ion complex.

3. The method of claim 1, wherein said solution contains about 0.005 to 0.5 mol/l bromate.

4. The method of claim 1, wherein said solution contains about 0.1 to 7 mol/l water-soluble chloride.

5. The method of claim 1, wherein said ferric ion complex is a complex of a ferric ion and an aminopolycarboxylic acid, an aminopolyphosphonic acid or salts thereof.

6. The method of claim 1, wherein said bromate is an alkali metal or an ammonium salt of bromic acid.

7. The method of claim 1, wherein said chloride is an alkali metal chloride or ammonium chloride.

8. The method of claim 1, wherein said solution has a pH of about 2 to 8.

9. The method of claim 1, wherein said solution additionally contains an aliphatic carboxylic acid, an aliphatic phosphonic acid or an aliphatic phosphonocarboxylic acid.

10. The method of claim 9, wherein said acid is present in an amount of about 0.5 to 5 mol/l.

11. The method of claim 1, wherein prior to processing with said solution, said silver halide color photographic material is treated with a solution of a substituted alkylthio compound or precursor thereof.

12. The method of claim 11, wherein said alkylthio compound is represented by the formula:

R—S—Y wherein R represents an alkyl group containing 1 to 8 carbon atoms which may be substituted and Y represents a hydrogen atom or an amidino group.

13. The method of claim 12, wherein said alkylthio compound is present in an amount of about $1\times10^{-5}$ to 1 mol/l.

14. The method of claim 1, wherein said method comprises, in sequence, color development, stopping, bleaching with said solution, washing, fixation, washing, stabilization, and drying.

15. The method of claim 1, wherein said method comprises, in sequence, color development, stopping, bleaching, fixation, washing, stabilization and drying.

16. The method of claim 1, wherein said method comprises, in sequence, color development, stopping-fixation, bleaching, fixation, washing, stabilization and drying.

17. The method of claim 1, wherein said method comprises, in sequence, black-and-white development, stopping, washing, fogging, washing, color development, stopping, washing, bleaching, washing, fixation, washing, stabilization, and drying.

18. The method of claim 1, wherein said method comprises, in sequence, color development, bleaching, washing, fixation, washing, stabilization, drying, color development, bleaching, fixation, washing and drying.

19. The method of claim 1, wherein said method comprises, in sequence, black-and-white development, stopping, washing, fogging, washing, color development, stopping, washing, bleaching, fixation, washing, stabilization and drying.

20. The method of claim 1, wherein said color photographic material contains silver in a total amount of at least about 30 mg per 100 $cm^2$.

21. The method of claim 9, wherein said color photographic material is a reversal color photographic material.

22. The method of claim 1, wherein said color photographic material is a color negative photographic material.

23. The method of claim 12, wherein said alkylthio compound is 2-mercaptoethanol, thioglycerol, or N,N-dimethylaminoethanethiol or a precursor thereof.

24. The method of claim 1, wherein said color photographic material is a color paper.

25. The method of claim 1, wherein said color photographic material is a color positive film.

* * * * *